United States Patent [19]

Schirtzinger

[11] 4,170,187

[45] Oct. 9, 1979

[54] ARCTIC DRILLING AND PRODUCTION PLATFORM

[75] Inventor: Joseph F. Schirtzinger, Pasadena, Calif.

[73] Assignee: Sea-Log Corporation, Pasadena, Calif.

[21] Appl. No.: 872,609

[22] Filed: Jan. 26, 1978

[51] Int. Cl.[2] ..... B63B 35/44

[52] U.S. Cl. ..... 114/264; 114/42; 114/67 A; 115/1 R; 180/119

[58] Field of Search ..... 114/40–42, 114/43, 67 A, 264; 280/638, 79.1 R, 79.2; 180/119; 37/50; 172/240, 287; 115/1 R

[56] References Cited

U.S. PATENT DOCUMENTS

| | | | |
|---|---|---|---|
| 3,610,661 | 10/1971 | Pierce et al. | 172/240 X |
| 3,632,172 | 1/1972 | Robinson et al. | 114/42 X |
| 3,693,729 | 9/1972 | Blurton et al. | 180/119 X |
| 3,973,509 | 8/1976 | Waas | 114/42 |

*Primary Examiner*—Trygve M. Blix

*Assistant Examiner*—Sherman D. Basinger

*Attorney, Agent, or Firm*—Christie, Parker & Hale

[57] ABSTRACT

A mobile drilling and production platform for arctic regions in which a hull having a deck forming the production platform is supported on a first set of parallel runners secured to the underside of the hull and extending fore and aft with spaces between the runners. A second set of parallel segmented runners are secured to the underside of the hull and extend perpendicular to the first set of runners, the second set of runners including a plurality of sections positioned in the spaces between the first set of runners. A plurality of rotating ice cutters are mounted on the hull and extend down in front of the ends of each of the runners, the ice cutters cutting channels in the ice in which the runners move and support the hull. One set of runners is vertically movable from the hull relative to the other set of runners whereby the weight of the hull can be transferred from one set of runners to the other to permit movement of the platform along two perpendicular axes or coordinance of motion.

7 Claims, 3 Drawing Figures

ARCTIC DRILLING AND PRODUCTION PLATFORM

FIELD OF THE INVENTION

This invention relates to mobile drilling platforms for use in arctic regions, and more particularly, to a drilling platform supported on runners.

BACKGROUND OF THE INVENTION

With the widening search for petroleum there has been an increasing need to carry out exploratory drilling and other resource development operations in the frozen arctic regions. The problems associated with the remoteness of the area are compounded by the presence of an ice cover, intermittent in some areas, which may be moving under the action of wind and ocean currents. Pressure ice forms ice ridges in some areas while other areas remain as open water in a constantly changing pattern. These conditions preclude the use of conventional open water drilling units as well as conventional land based drilling techniques. Airborne carriers supported on an air bubble have also been proposed but are costly to operate and have other technically limiting capabilities.

SUMMARY OF THE INVENTION

The present invention is directed to a platform for supporting a drilling rig which employs two sets of runners on which the platform is supported. The first set of runners extend parallel to each other in a fore-aft direction and are secured to the underside of the platform. A second set of runners extends at right angles to the first set of runners with the segments extending between the parallel runners. One set of runners is vertically movable with respect to the other set of runners so that the platform can be caused to rest on one or the other of the set of runners. Ice cutters are positioned at both ends of each of the runners in both sets of runners for cutting tracks in the ice through which the runners are guided. The tracks provide a smooth running surface and by engaging the runners prevent lateral movement of the platform due to the action of crosswinds, sideslopes, and the like. The sets of tracks may be enclosed by a skirt which provide a plenum chamber beneath the platform which can be pressurized to partially relieve the load supported on the runners.

DESCRIPTION OF THE DRAWINGS

For a more complete understanding of the invention reference should be made to the accompanying drawings, wherein.

DETAILED DESCRIPTION

Figure 1:
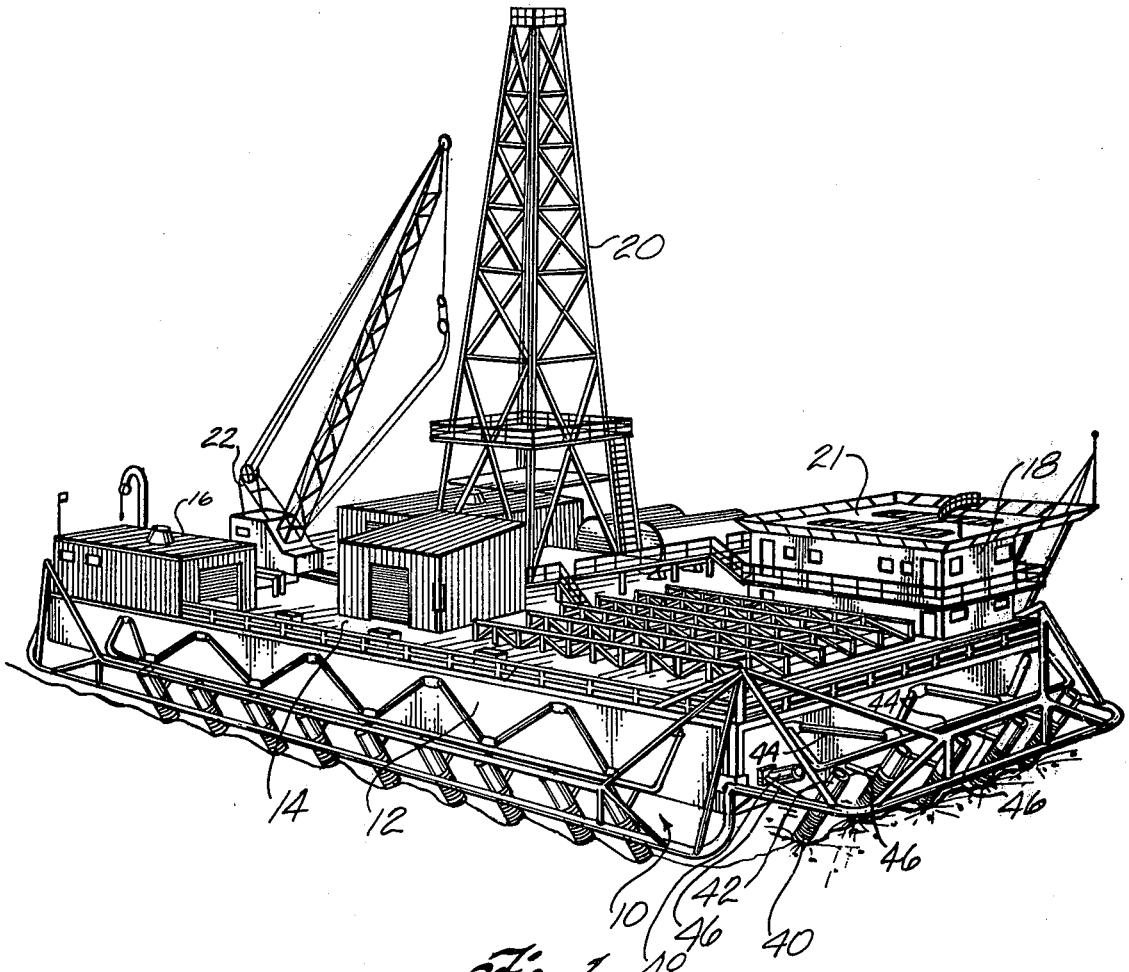
FIG. 1 is a perspective view of the drilling platform of the present invention showing the bow end of the vessel.
Figure 2:
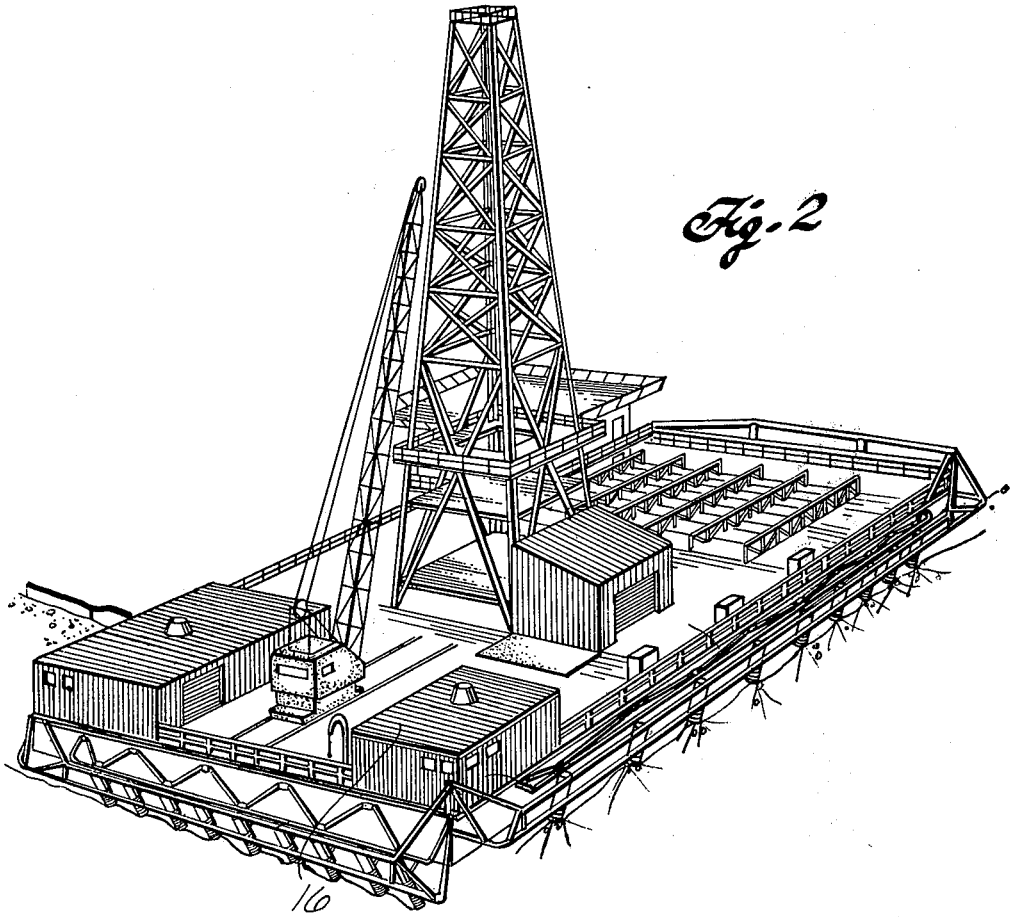
FIG. 2 is a perspective view of the drilling platform showing the stern end of the platform.

Referring to the drawings in detail, the numeral 10 indicates generally an arctic vehicle incorporating the features of the invention. The vehicle 10 includes a hull 12 having a deck or platform 14. The deck provides storage base for the transport of drilling pipe and other materials to and from the drill site. An engine room 16 is provided in which power generating equipment is located for generating the prime energy requirements to propel the vessel and to provide other electrical and power requirements for operating the vessel. The crews quarters and control room vacilities are located in a control tower 18 which may also provide a landing pad 21 for a helicopter to attend and to change crews, and the like. A drilling tower 20 is located amidships. A crane 22 may be provided for loading equipment aboard the vehicle.

The hull 12 is provided with a skirt 24 extending around the entire perimeter and extending downwardly. The skirt and underside of the hull 12 form a plenum chamber 26 with the ground. Air is forced under pressure into the plenum chamber 26 by a blower or fan unit 28, providing a cushion of air for at least partially supporting the weight of the vehicle.

Figure 3:
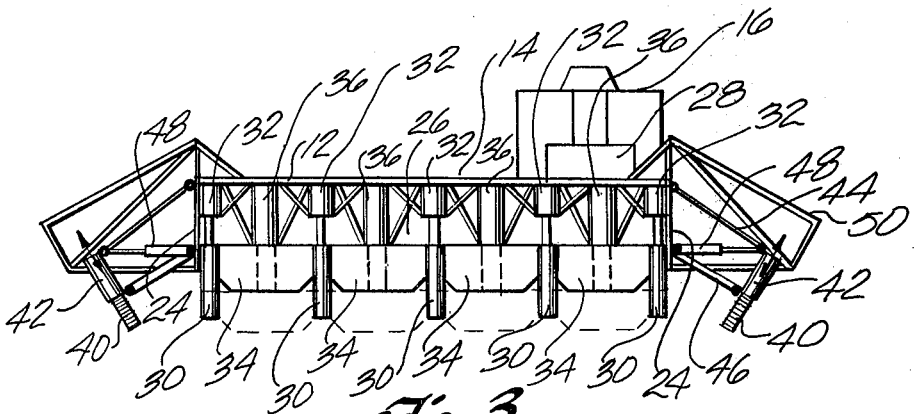
FIG. 3 is a sectional view of the same vehicle.

Positioned within the plenum chamber 26 below the hull 12 are a pluality of longitudinal runners 30 running the full length of the vehicle. The runners are supported from the deck 14 by a plurality of hydraulic actuators 32 by which the runners can be raised and lowered relative to the hull 12. As viewed in FIG. 3, the runners 30 are shown in the extended position for engaging the surface of the ice over which the vehicle is supported. The runners 30 provide at least partial support and guidance in a fore and aft direction for the vehicle. A plurality of parallel segmented cross-runners are also provided, the individual segments of one of the cross-runners being indicated at 34 in FIG. 3. The individual segments of each cross-runner extend between the adjacent pairs of longitudinal runners 30. The individual cross-runners are spaced parallel to each other at intervals preferably equal to the spacing between the longitudinal runners 30. Thus the cross-runners and logitudinal runners combine to form rectangular or egg-crate pattern of runners within the plenum chamber 26. The cross-runner segments 34 are supported from the hull 12 by a plurality of hydraulic actuators 36 which are operated to raise and lower the cross-runner segments 34 relative to the hull 12. As shown in FIG. 3, the cross-runner segments 34 are in their fully retracted position, thus leaving the extended longitudinal runners 30 free to engage the ice. By extending the actuators 36 and lowering the segments of the cross-runners into the dotted position indicated in FIG. 3 while retracting the longitudinal runners 30, the cross-runners can be brought into engagement with the surface of the ice and the longitudinal runners disengaged from the ice. In this manner, the the load can be transferred from the longitudinal runners to the cross-runners to permit lateral movement of the vehicle across the surface of the ice.

In order to smooth the ice and to cut tracks in the ice for the runners, four sets of ice-cutters are provided respectively along the four margins of the hull 12. Each set of ice-cutters includes rotary cutter elements 40 driven at high speed by motors 42. The motors 42 are adjustably supported on an upper arm assembly 44 and a lower arm assembly 46. The upper arm assembly 44 is hinged to the side of the hull 12 and to the top of the motors 42. The lower arm assembly in turn is also hinged to the side of the hull into the lower end of the motors 42. Hydraulic actuators 48, as best seen in FIG. 3, operate to raise and lower the motors 42 and associated cutters 40. The arm assemblies 44 and 46 hold the axis of rotation of the cutters 40 at a slightly tilted angle to the vertical so that the ice cutter chips will be thrown out of the cut path. Since expelled ice may strike the sides of the hull, the sides are preferably covered with an elastomeric surface to prevent damage to the hull structure. The individual ice cutters along the bow and stern of the vessel are positioned directly in front and to the rear of the longitudinal runners 30 in position to cut grooves in the ice along which the runners are guided. The individual ice cutters along the sides of the vessel are positioned in line with the cross runners. The ice cutters may be any rotary or reciprocating or like device capable of chipping or cutting the ice. One such system is described in U.S. Pat. No. 3,521,592 to Rosner et al. Each set of cutters is surrounded by a protective guard 50 to shield the cutters.

From the above description, it will be seen that the ice-cutters 40 provide tracks or furrows through the ice or irregular hard frozen ground to provide a surface upon which the runners may move. The vehicle may be moved either in a fore and aft direction or in a side-to-side direction by respectively lowering the longitudinal runners 30 or the cross-runner segments 34. The air cushion reduces the weight carried by the individual runners allowing them to move more easily along the tracks cut in the ice. The tracks provide guidance of the vehicle, preventing it from slipping sideways from the intended path. The vehicle may be towed by a tractor or powered by winches mounted on the platform through cables anchored to the ice. The vehicle may also be directly driven by engines aboard the platform in a conventional manner.

What is claimed is:

1. A drilling and production platform vessel for use in arctic regions, comprising: a hull having a deck, a first set of spaced parallel runners secured to the underside of the hull extending fore and aft with spaces between the runners, a second set of parallel runners secured to the underside of the hull and extending perpendicular to the first set of runners, the second set of runners including a plurality of sections positioned in the spaces between the first set of runners, means for moving at least one set of runners vertically relative to the other set of runners, whereby the weight of the hull can be transferred from one set of runners to the other by raising and lowering the one set of runners to a position above or below the other set, and means including a plurality of rotating ice cutters mounted on the hull, said ice cutters being positioned to cut grooves in the ice in front of both sets of runners for cutting channels in the ice in which the runners move and support the hull.

2. Apparatus of claim 1 further including means for raising and lowering the ice cutters.

3. Apparatus of claim 2 wherein the ice cutters are positioned at both ends of each runner in both sets of runners.

4. Apparatus of claim 3 wherein the ice cutters are individually rotatable about an axis extending substantially vertically but angled slightly so the upper end of each cutter is further away from the hull than the lower end.

5. Apparatus of claim 3 wherein the ice cutters are positioned on all sides of the hull, the cutters on each side of the hull being movable vertically as a group.

6. Apparatus of claim 1 further including skirt means projecting downwardly of the hull around the perimeter to form a plenum chamber below the vessel, and means for pneumatically pressurizing the plenum chamber to provide lift for the hull.

7. An amphibious vehicle for the transport of cargo over the ice, water and frozen ground surfaces which comprises:

a cargo carrying hull including a source of power for the vehicle and means to control operation of the vehicle;

two sets of spaced runners beneath the undersurface of the hull, one set running lengthwise of the cargo carrying hull and the other set running laterally of the hull;

means for raising and lowering one set of runners relative to the other set to bring one set or the other into engagement with the surface below the hull;

ice cutting means positioned forward of each runner adapted to cut a track in the surface of ice and frozen ground of a width and depth at least sufficient to engage the runner to provide a running surface and prevent lateral movement of the vehicle by the action of crosswinds;

seal means adapted to form sealing contact between the undersurface of the hull and water, ice and frozen ground surfaces to form in combination with the runners a plenum chamber; and means to induce the flow of a gaseous medium into the plenum chamber to pressurize the plenum chamber and provide lift to the vehicle to minimize friction between the runners and the cut track and minimize friction during transit of the vehicle.

* * * * *